US005257910A

United States Patent [19]

Hergt et al.

[11] Patent Number: 5,257,910

[45] Date of Patent: Nov. 2, 1993

[54] CENTRIFUGAL PUMP IMPELLER WITH A LOW SPECIFIC SPEED OF ROTATION

[75] Inventors: Peter Hergt, Ludwigshafen; Alexander Nicklas, Dirmstein; Salvatore Scianna, Weissenheim/Berg, all of Fed. Rep. of Germany

[73] Assignee: KSB Aktiengesellschaft, Frankenthal, Fed. Rep. of Germany

[21] Appl. No.: 691,049

[22] PCT Filed: Dec. 12, 1989

[86] PCT No.: PCT/EP89/01522

§ 371 Date: Jun. 20, 1991

§ 102(e) Date: Jun. 20, 1991

[87] PCT Pub. No.: WO90/07650

PCT Pub. Date: Jul. 12, 1990

[30] Foreign Application Priority Data

Dec. 23, 1988 [DE] Fed. Rep. of Germany ..... 3843428

[51] Int. Cl.[5] ..... F01D 5/14

[52] U.S. Cl. ..... 416/223 B

[58] Field of Search ..... 416/223 B, 181; 415/206

[56] References Cited

U.S. PATENT DOCUMENTS

| | | | |
|---|---|---|---|
| 1,986,836 | 1/1935 | Macneille | 415/206 |
| 1,988,875 | 1/1935 | Saborio | 415/206 |
| 2,074,650 | 3/1937 | Holdaway | 415/206 |
| 2,956,503 | 10/1960 | Neidl | 416/223 B |
| 3,244,109 | 4/1966 | Barske | 415/206 |

FOREIGN PATENT DOCUMENTS

| | | | |
|---|---|---|---|
| 644854 | 7/1962 | Canada | 416/223 B |
| 1249693 | 9/1967 | Fed. Rep. of Germany . | |
| 1453723 | 7/1969 | Fed. Rep. of Germany . | |
| 529613 | 12/1921 | France . | |
| 102212 | 8/1962 | Netherlands | 416/223 B |
| 620674 | 8/1978 | U.S.S.R. . | |
| 1052053 | 10/1984 | U.S.S.R. | 416/223 B |
| 928080 | 8/1988 | U.S.S.R. . | |
| 575346 | 2/1946 | United Kingdom . | |

*Primary Examiner*—John T. Kwon
*Attorney, Agent, or Firm*—Peter K. Kontler

[57] ABSTRACT

An impeller for a centrifugal pump has an axis of rotation. The impeller includes a pair of covers which cooperate to define a chamber, and blades in the chamber defining generally radial flow channels. Each of the covers has a wall which is oriented transverse to the axis of rotation. The walls are provided with cutouts at the periphery of the impeller and one cutout is associated with each flow channel. The radial lengths of the cutouts are equal to or less than one-half the lengths of the flow channels. Each flow channel and its respective cutout cooperate to define an aperture which opens to the exterior of the chamber both axially and radially.

13 Claims, 3 Drawing Sheets

CENTRIFUGAL PUMP IMPELLER WITH A LOW SPECIFIC SPEED OF ROTATION

BACKGROUND OF THE INVENTION

The invention relates to a centrifugal pump impeller.

The British patent publication 575,346 A and the German patent publication 1,249,693 C describe single-piece impellers for centrifugal pumps, which operate in the range of minimum specific speeds of rotation. Such impellers have the feature that the actual vane ducts are produced by machining tools, having a straight form and along their entire length have constant circular cross section. In comparison with other known impellers with a vane duct widening like a diffusor, they have the advantage of simple manufacture but have the disadvantage of poor hydraulic efficiency.

Another design is illustrated in the Russian patent publication 620,674 A. This has a so-called open impeller, in the case of which the vane duct remains open along its entire length. It represents an unusual design to the extent that in this case the vane ducts are open drilled impeller ducts provided with a longitudinal slit. At the discharge port this design has the feature that the delivery part is made very much narrower than the vane ducts so that there are substantial pressure losses. The hydraulic efficiency is accordingly greatly impaired. Furthermore, the open impeller leads to an axial thrust towards the intake end.

SUMMARY OF THE INVENTION

One object of the invention is to provide a centrifugal pump impeller for small delivery rates and large delivery head, which furthermore provides for an increase in the pressure number and also an improvement in efficiency.

Owing to the design in accordance with the invention there is the substantial advantage over conventional centrifugal pump impellers with closed cover plates of an increase in the pressure coefficients specific to the impeller. As a consequence of the vane ducts being left open at the impeller delivery part, there is an exchange of momentum between the liquid in the duct and the liquid in the impeller side space. This in turn leads to a increase in energy, the consequence of this being an increase in the delivery head and an increase of the pressure coefficient. In contradistinction to side duct pumps there is in this case a substantial improvement in efficiency, since the forms of loss typical for side duct pumps are no longer able to occur.

According to one embodiment of the invention, there is an oblique intersection of the respective vane ducts. This renders possible different slopes of the impeller cover plate and/or the vane ducts. This in turn leads to as gradual opening of the vane ducts, owing to which there is an advantageous effect on the liquid flowing within the vane ducts. In this connection it is possible to adopt the feature with which the distance between the impeller cover and the opposite housing wall is at the most equal to the difference between the vane duct depth as measured at the impeller outlet in the axial direction and a vane duct depth as measured at the outward projection of the vane duct wall at the external diameter of the impeller. In accordance with another embodiment of the invention, the configuration of the vane duct openings, renders possible a smooth, controlled effect on the flow within the vane ducts. The designs in accordance with the invention are responsible for comparatively stable characteristics accompanied by equally satisfactory intake properties. There is also the further advantage that owing to the design of the impeller it is possible to do without the conventionally utilized projecting suction opening in centrifugal pumps and the choke gaps provided at this position. Dependent on the method of production of the vane ducts, be it by machining or by a suitable casting process, it is possible for such impellers to be utilized in a delivery rate range of up to 15 $m^3/h$ (with n equal to 2900 rpm).

According to an additional embodiment of the invention, the vane ducts widen from their inlet ends to the outer diameter of the impeller continuously. This feature means that there is a gentle start of exchange of momentum which slowly increases towards the outlet.

BRIEF DESCRIPTION OF THE DRAWINGS

Preferred embodiments of the invention will now be described with reference to the accompanying drawings wherein.

DESCRIPTION OF THE PREFERRED EMBODIMENTS

Figure 1:
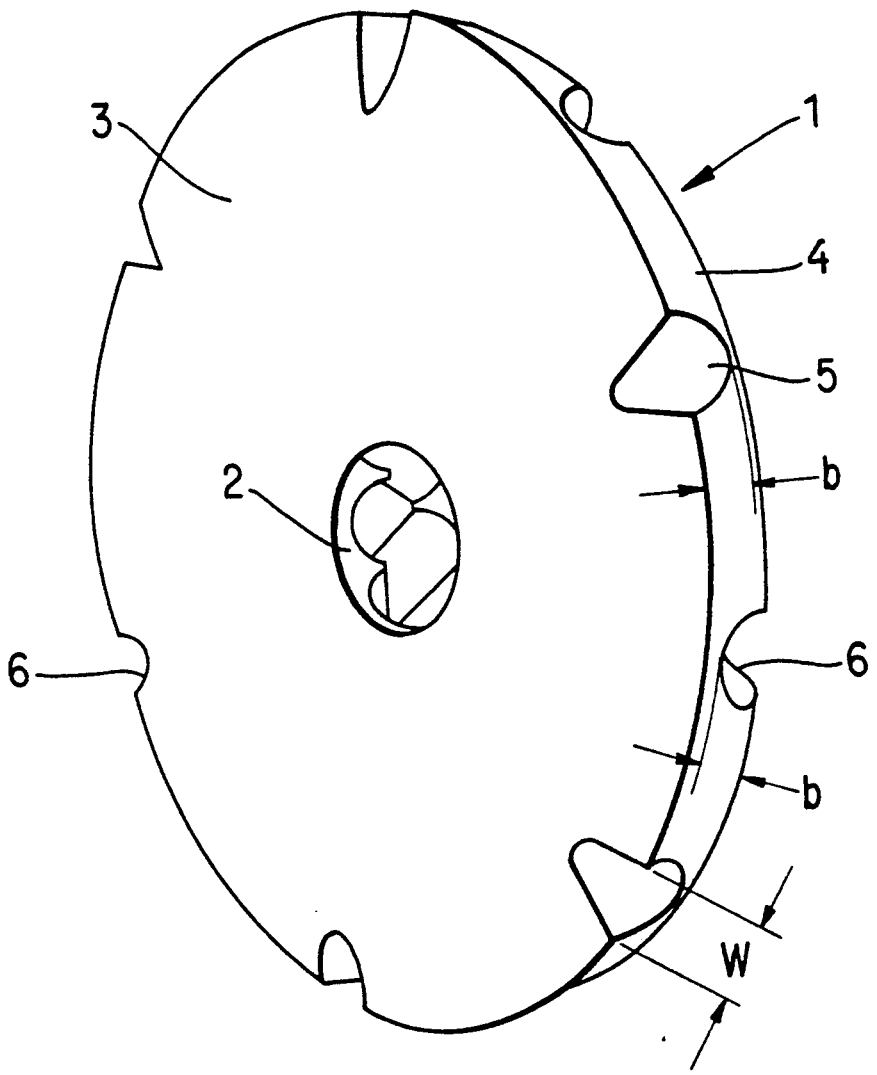
FIG. 1 is a perspective elevation of the impeller.
Figure 4:
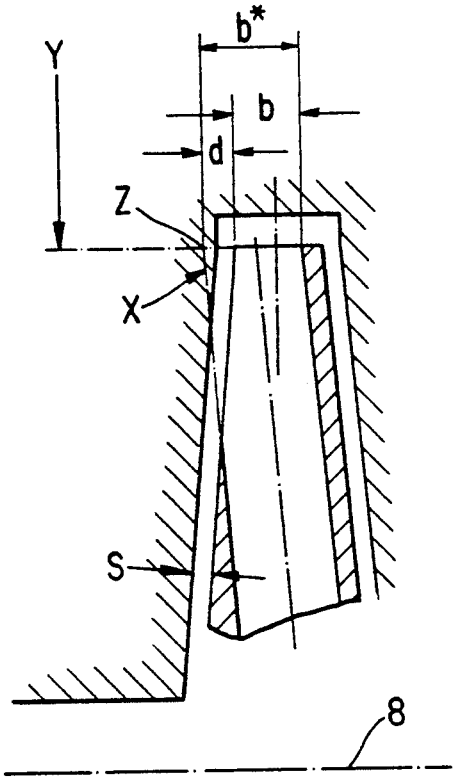
FIG. 4 is an elevation of part of the delivery part of the impeller.
Figure 5:
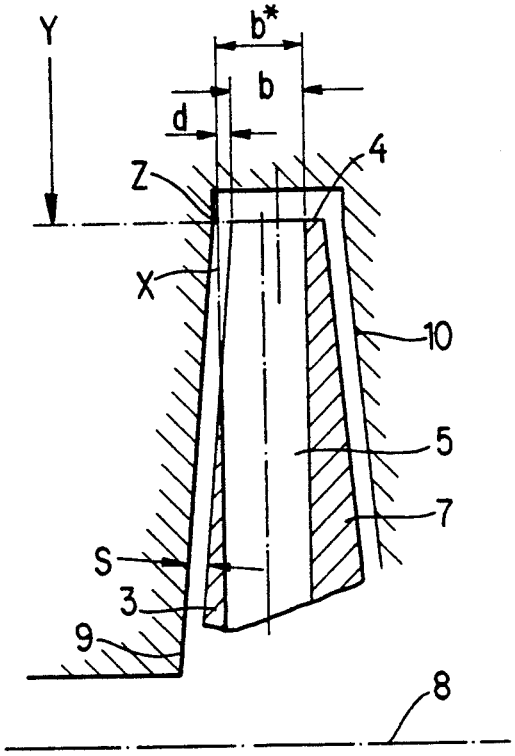
FIG. 5 is another embodiment of the invention.
Figure 6:
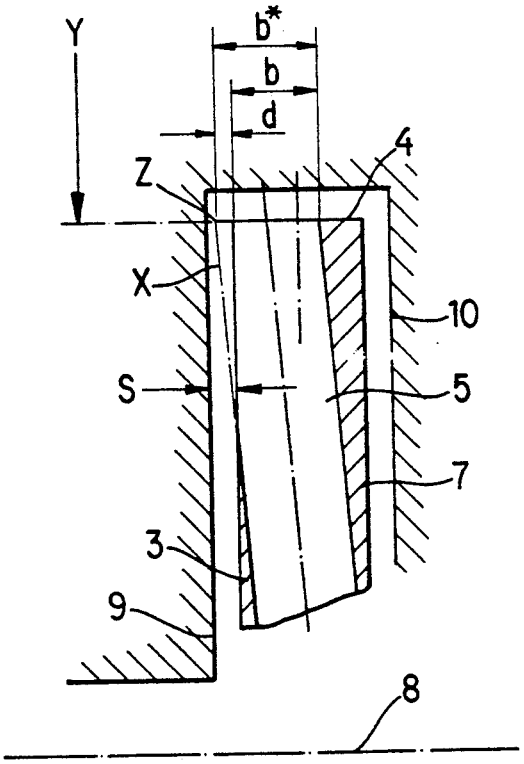
FIG. 6 is another embodiment of the invnetion.
Figure 7:
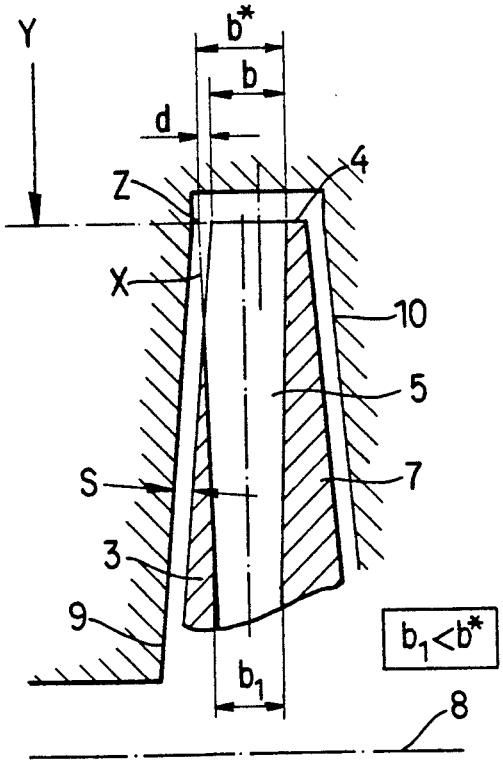

The impeller 1 illustrated in FIG. 1 has an intake opening 2, through which the fastening means for the connection with a pump shaft, which is not illustrated, may be introduced. The impeller cover plate 3 on the intake side, is in the present case made with a smooth surface and has a slope which at the external diameter 4 intersects the vane ducts 5 obliquely. In the case of the example selected here the vane ducts 5 extend from the center of the impeller outwards radially. The configuration of the impeller ducts 5 selected here is such that they have a circular cross section: however other forms of cross section would be conceivable. For instance, the vane ducts 5 might be produced by having holes drilled into the impeller from the outside. It is possible as well to use a suitable foundry technique to manufacture the vane ducts with the desired form. Furthermore, there is the possibility of cutting up the impeller in a plane intersecting the axis of rotation and of machining the forms of the vane ducts in the two halves and then of joining together the two halves to give an integral structure. The vane duct holes 5 illustrated in this case may also extend in the tangential direction. At the external diameter 4 of the impeller each vane duct has an opening 6 which becomes wider in the outward direction. At the outer diameter the directly measurable vane duct breadth is indicated at b. This is the vane duct breadth minus an amount corresponding to the oblique section. The ascertainable vane duct breadth b*, which is the unmodifiable vane duct breadth, is determined by projection that vane duct wall, which is nearest to the cover plate having the opening 6, through the opening 6 outwards. As shown in FIG. 4, the point of intersection z of the projection x at the cylindrical plane 4 of the impeller external diameter constitutes a limit value, whereas the vane duct wall positioned opposite to the latter forms another limit including the ascertainable vane duct breadth b*.

Figure 2:
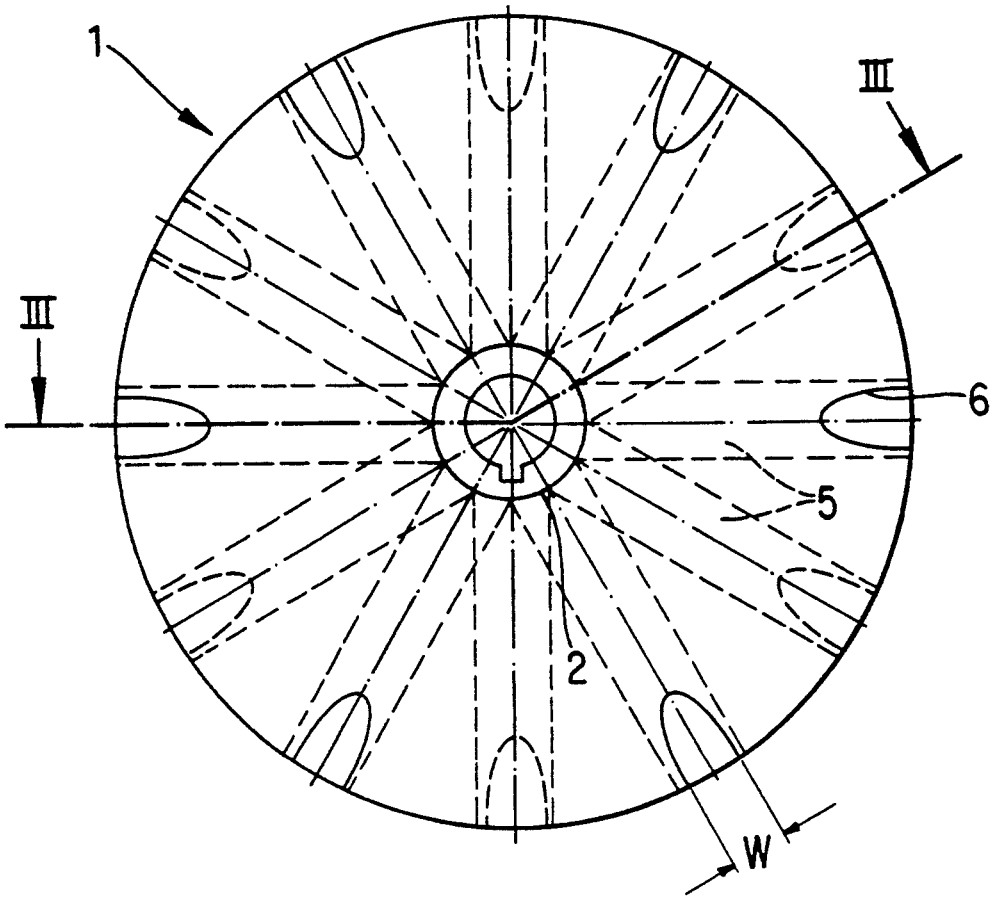
FIG. 2 is a front side elevation.

FIG. 2 shows a view to indicate the course of the vane duct within the impeller. According to the selected number of the vane ducts there is an overlap, also visible in FIG. 1, in the intake part of the impeller, this being a design criterion for influencing the delivery rate of the impeller. In the case of a lesser number of vane ducts, and small vane duct cross section and a suitable intake diameter of the impeller it is possible to manufacture an impeller, whose vane ducts 5 do not intersect or overlap in the intake part. The impeller 1 illustrated here by way of example has in the case of a given external diameter 4 a number and configuration of the vane ducts 5, which in the case of the illustrated impeller intake 2 involved overlap or intersection of the vane ducts in the intake.

The more ducts there are arranged over the periphery, the larger the diameter on which the actual leading edges of the respective vane ducts lie. By suitably designing the size of the intake opening 2 constituting the impeller intake there is another possibility of varying the pumping rate.

The openings 6 have a width w, which is smaller than the maximum width of the vane ducts 5. By suitably selecting the slope of the vane ducts or of the cover plate it is possible to vary the size of the width w.

Figure 3:
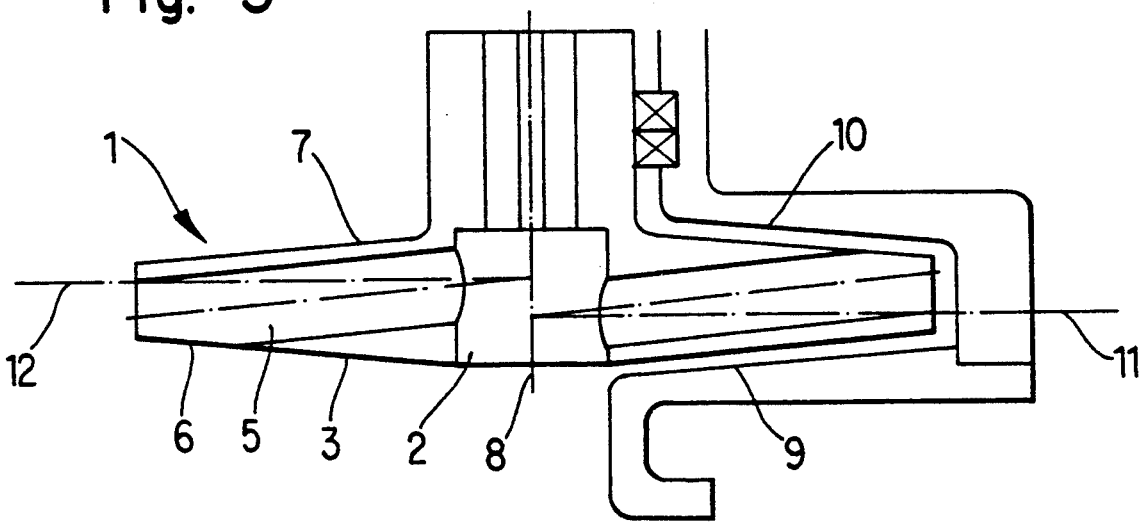
FIG. 3 is a section taken on the line III—III of FIG. 2.

In the case of the embodiment of the invention illustrated in FIG. 3 corresponding to a section taken on the line III—III of FIG. 2, the course of the sloping vane ducts 5 and 13 and the slope of the impeller covers 3 and 7 will be apparent. The vane ducts and the impeller cover plates here extend at a slope in relation to the planes 11 and 12 which are perpendicular to the axis 8 of rotation, in relation to planes 11 and 12 which are perpendicular to the axis 8 of rotation. In an alternating manner the one vane duct is inclined towards the suction side cover plate 3 and the adjacently placed vane duct is inclined towards the pressure side cover plate 7. By making a suitable selection of the angles of inclination of the vane ducts and/or of the angles of inclination of the cover plates it is possible to achieve an intersection of the vane ducts in the impeller delivery part. This provides a simple way of designing the actual vane duct opening 6 having the width w shown in FIG. 2. In the right hand side of FIG. 3 it is possible to see that the housing wall 9 is opposite the impeller on the intake side and the housing wall 10 is opposite the impeller of the discharge side. Although the walls 9 and 10 are parallel to the respective impeller cover plates, this is not absolutely essential and in fact different slopes would be possible.

It will be seen from FIG. 4 that adjacent to the openings 6 between the impeller cover plate 3 and the intake side housing wall 9 there is a distance s, which is less than the difference d between the measurable breadth b and the ascertainable vane duct breadth b*. For reliable functioning of the openings 6 the distance s may at the most only be equal to the difference d. A larger value would not lead to the desired effect. The distance s is in this case less than the indicated difference d.

In accordance with the selected distance s it is possible to modify the characteristics of the pump in a simple manner.

The value b* may be determined by projecting the vane duct wall, which is provided with the opening 6 and is next to the housing, outwards towards the external diameter 4 of the impeller. Starting at the point of intersection z between the projection x and the cylindrical plane y of the external diameter of the impeller the vane duct breadth b* is determined in the vane duct. This may apply both for the intake and for the discharge side of the impeller.

The distance s is always determined for one side of the impeller, that is, the intake or the discharge side. Depending upon the particular conditions it is possible for the distance s between the housing wall and the cover plate of the impeller on the intake side to be equal to or different from the distance s between the housing wall and the cover plate of the impeller on the discharge side. If vane ducts are present on only one side of the impeller, the distance s will at the most be equal to the difference d. When open vane ducts are present on both sides the distance s is set in accordance with the dimensions on the respective side of the impeller.

We claim:

1. An impeller for a centrifugal machine, said impeller having an axis of rotation and comprising a first cover; a second cover defining a chamber with said first cover, said first cover and said second cover having substantially the same peripheries each of said covers including a wall which is oriented transverse to said axis, and at least one of said walls being provided with a cutout; and guiding means in said chamber defining at least one flow channel, said flow channel and said cutout together defining an aperture which opens to the exterior of said chamber both axially and radially.

2. The impeller of claim 1, wherein said flow channel has a predetermined length and said cutout has a radial length equal to or less than about one-half of said predetermined length.

3. The impeller of claim 1, wherein said flow channel extends generally radially.

4. The impeller of claim 1, wherein said covers and said guiding means together define a unit designed for operation in a centrifugal pump at low specific speed.

5. The impeller of claim 1, wherein said flow channel is substantially normal to said axis and said one wall has an outer surface portion which is inclined to said axis, said flow channel having a discharge end, and said surface portion intersecting said flow channel in the region of said discharge end.

6. The impeller of claim 1, wherein said axis is cut by a radial plane and said flow channel is inclined to said plane, said flow channel having a discharge end, and said one wall including an outer surface portion which intersects said flow channel in the region of said discharge end.

7. The impeller of claim 1, wherein said one wall has an outer surface portion, said flow channel and said outer surface portion being inclined relative to one another.

8. The impeller of claim 1, wherein said covers and said guiding means together define a unit having a periphery, said flow channel being bounded by a first surface portion which extends to said periphery and a second surface portion which is axially opposite said first surface portion and terminates short of said periphery, and said flow channel having a first depth equal to the distance between said first and second surface portions, and a different second depth equal to the axial spacing, as measured at said periphery, between said one wall and said first surface portion; and further comprising a housing for said unit having a housing portion which confronts and is axially spaced from said one wall, the spacing between said one wall and said housing portion being at most equal to the difference between said first and second depths.

9. The impeller of claim 1, wherein said flow channel has a discharge end and said cutout is provided at said discharge end.

10. The impeller of claim 9, wherein covers and said guiding means together define a unit having a periphery and said cutout widens in a direction from said axis towards said periphery.

11. The impeller of claim 9, wherein said flow channel has a predetermined width and said cutout has a maximum width at most equal to said predetermined width.

12. The impeller of claim 9, wherein said covers and said guiding means together define a unit having a periphery and said flow channel diverges in a direction from said axis towards said periphery.

13. The impeller of claim 12, wherein said flow channel has a first end remote from said axis and a second end nearer said axis, said flow channel diverging continuously from said second end to said first end.

* * * * *